US005890672A

United States Patent [19]

Alexander, III et al.

[11] Patent Number: 5,890,672

[45] Date of Patent: Apr. 6, 1999

[54] SURFACE WINDER APPARATUS AND METHOD

[75] Inventors: William J. Alexander, III, Mauldin; Shala W. Summey, III, Greer, both of S.C.

[73] Assignee: Alexander Machinery, Inc., Mauldin, S.C.

[21] Appl. No.: 782,581

[22] Filed: Jan. 13, 1997

Related U.S. Application Data

[63] Continuation of Ser. No. 574,759, Dec. 20, 1995, abandoned.

[51] Int. Cl.[6] ..... B65H 16/08; B65H 18/20; B65H 23/185; B65H 23/198

[52] U.S. Cl. ..... 543/413.5; 242/420.1; 242/420.6; 242/542.1

[58] Field of Search ..... 242/542.1, 413.5, 242/420.1, 420.6, 595.1

[56] References Cited

U.S. PATENT DOCUMENTS

| | | | |
|---|---|---|---|
| 1,868,285 | 7/1932 | Francis | 242/542.1 |
| 1,888,810 | 11/1932 | Sieg | 242/542.1 |
| 1,966,214 | 7/1934 | Palmer | 242/413.5 |
| 2,509,250 | 5/1950 | Roberts | 242/413.5 |
| 3,377,033 | 4/1968 | Link | 242/542.1 |
| 3,684,273 | 8/1972 | Benson et al. | 242/420.1 |
| 4,216,804 | 8/1980 | Alexander et al. | 242/413.5 |
| 4,588,931 | 5/1986 | Alexander | 242/542.1 |
| 5,022,597 | 6/1991 | Morizzo | 242/413.5 |
| 5,289,087 | 2/1994 | Summey | 242/542.1 |

FOREIGN PATENT DOCUMENTS

| | | | |
|---|---|---|---|
| 59-48346 | 3/1984 | Japan | 242/542.1 |
| 61-37654 | 2/1986 | Japan | 242/542.1 |

*Primary Examiner*—John M. Jillions
*Attorney, Agent, or Firm*—Ralph Bailey

[57] ABSTRACT

The speeds of support rolls (A) and (B) of a surface winder are controlled during winding by sensing means including a movable roll (C) for detecting variations in web tension. The motors (F) and (G) are controlled responsive to the sensing means by motor control circuitry (H) and, through respective drives (D) and (E), independently drive the rolls (A) and (B).

1 Claim, 3 Drawing Sheets

SURFACE WINDER APPARATUS AND METHOD

This application is a continuation of application Ser. No. 08/574,759 filed Dec. 20, 1995 now abandoned.

BACKGROUND OF THE INVENTION

This invention relates to an improved surface winder apparatus and method utilizing first and second drives independently driving respective support rolls carrying a roll core for accurately tensioning cloth delivered thereto from a loom and providing an adjustable packing ratio for winding the cloth into a roll.

U.S. Pat. No. 4,216,804 illustrates a tension control apparatus for cloth delivered from a weaving machine to a surface winder. Such take-ups are generally positioned in front of the weaving machine and a sensing device including a movable roll engages the cloth coming from the loom for mechanically driving suitable motor control devices responsive to movement of the roll caused by variations in cloth tension. The tension control apparatus incorporates a single drive motor directly driving one support roll which in turn drives the other roll through a chain. The sprockets which drive the chain have a differential in the number of sprocket teeth utilized for driving the chain connecting the support rolls in order to achieve a suitable packing ratio to build a firm cloth roll. The packing ratio is thus achieved by driving one of the rolls slightly faster than the other in order to tighten the cloth as it is wound upon the cloth roll. Such apparatus is incapable of providing the infinite variations in speed of the respective support rolls necessary to achieve a desired packing ratio in all fabrics and types of web-material.

Moreover, mechanical means as described above in connection with the patent, are utilized to drive a speed control mechanism such as a potentiometer, and such mechanical devices are often incapable of producing sufficiently accurate control as may be needed to control the build of certain web rolls. For example, certain heavy industrial fabrics such as those constructed of fiberglass may require more precise tension control. Efforts have been made to provide other controls for varying the packing ratios of take-ups including those illustrated in U.S. Pat. Nos. Re. 33,399 and 5,289,087, but these incorporate a single motor drive.

Separate motors and independent drives have been utilized in the prior art for controlling the spacing of surface winder support rolls wherein the space between the rolls increases according to a predetermined program as the size of the web roll increases during winding as disclosed in U.S. patent application Ser. No. 08/292,315, filed Aug. 19, 1994, entitled SPREAD WINDER AND METHOD in the name of William J. Alexander, III, Minnerd A. Blegen, and Shala W. Summey, III.

SUMMARY OF THE INVENTION

Accordingly, it is an important object of this invention to provide an improved apparatus and method for controlling the speeds of the respective support rolls of a surface winder in response to tension in the web, and to accurately afford desirable packing ratios for all types of web material.

Another important object of the invention is to provide an improved drive and method for controlling the packing ratios of a surface winder wherein separate drives are provided for driving the support rolls independently of each other.

Still another important object of the invention is to provide an improved surface winder apparatus and method wherein sensing mechanism includes a roll moved responsive to variations in web tension and a proximity switch actuated responsive thereto avoiding the use of mechanical drives for reflecting such variations in tension in a web being wound into a web roll for controlling the speed of the respective support rolls independently of a mechanical connection therebetween.

While the independent drives for the respective support rolls are described herein in the context of a take-up positioned in front of and receiving cloth manufactured by a producing machine, in this case, a weaving machine equipped with an inspection apparatus, it is to be understood that the improved apparatus and method may be advantageously utilized in connection with both take-ups and batchers including those utilized in winding and unwinding cloth and other web material such as plastic film or other sheet material. Sensing means other than the movable compensator roll operating a proximity switch may be utilized. Predetermined control settings may be utilized to aid in governing the speeds of the respective fixed support rolls through independent drives.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate a surface winder for supporting a roll core for receiving a web delivered thereto from a producing machine for winding thereon into a web roll. A pair of aligned support rolls A and B carry the roll core thereon during winding. Sensing means include a movable roll C, over which the web is moved so as to change the direction of movement of the web and to receive a force producing oscillatory movement thereof responsive to variations in tension in the web, is provided for sensing variations in tension upon the web delivered to the support rolls for winding upon the roll core. A first drive D is carried by one of the support rolls. A second drive E is carried by the other of the support rolls. The first and second drives drive respective support rolls A and B independently of each other. A first motor F drives the first drive D carried by one of the support rolls. A second motor G drives the second drive E carried by said other of the support rolls. A motor control circuit supplies power to and controls the speed of the motors responsive to the sensing means including the movable roll C sensing variations in tension upon said web. Thus, the speed of the support rolls may be controlled by independent drives.

Figure 1:
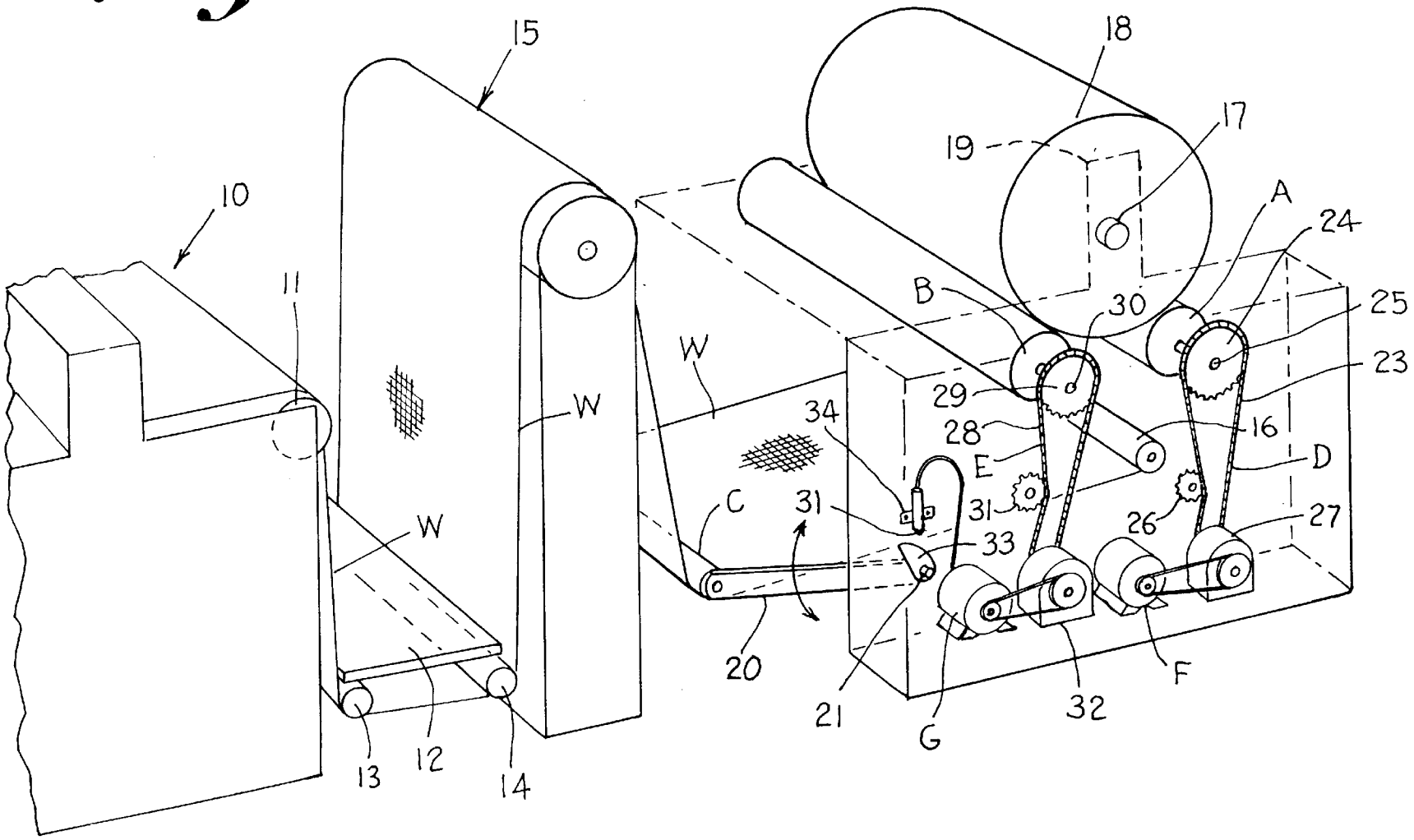
FIG. 1 is a perspective view illustrating an improved surface winder apparatus and method in accordance with the invention utilized in connection with a take-up for winding cloth delivered from a weaving machine.

Referring more particularly to FIG. 1, a weaving machine is broadly designated at 10. The weaving machine is illustrated as including a sand roll 11 over which the cloth W is illustrated as passing downwardly and beneath a worker's platform 12. The cloth web passes beneath the rolls 13 and 14 and thence upwardly over an inspection apparatus broadly designated at 15. The web W thence passes downwardly beneath a sensing roll C preparatory to passage over a guide roll 16. The web is delivered to the roll A for winding upon a roll core 17 into a web roll 18. The roll core is carried between a pair of spaced guides 19 for limiting transverse movement thus positioning the roll core and the web roll carried thereby in proper aligned position on the rolls A and B. The roll B is driven slightly faster than roll A in order to provide a desired package ratio to ensure suitable roll hardness during the build of the web roll 18.

It will be observed that the sensing roll C is supported in fixed or rotatable position on free ends of a pair of spaced pivoted arms 20. The arms 20 are carried on a shaft 21 for rotation on the frame 22 of the take-up. The support rolls A and B have respective drives D and E. The drive D is illustrated as including a chain 23 for driving a sprocket 24 carried by a shaft 25 forming a fixed axis for the roll A. The chain is provided with an idler sprocket 26 for ensuring proper tension in the drive which further includes a gear box 27 driven by a motor F.

A separate drive E is illustrated for the roll B which includes a chain 28 for driving a sprocket 29 carried by the shaft 30 forming a fixed axis for the roll B. An idler sprocket 31 is provided for providing proper tension for driving the gear box 32 which is in turn driven by the motor G.

The sensing mechanism is further illustrated as including a movable cam 33 carried by the shaft 21 for movement responsive to variations in tension in the web W as reflected in movement of the compensator or dancer roll C which thus senses the variations in tension in the web W. The cam 33 varies the output of a proximity switch 34 for controlling the action of a signal follower 35 illustrated in FIG. 2. Such sensing apparatus is more fully disclosed in U.S. Pat. No. 5,546,993 the disclosure of which is incorporated herein by reference.

Figure 2:
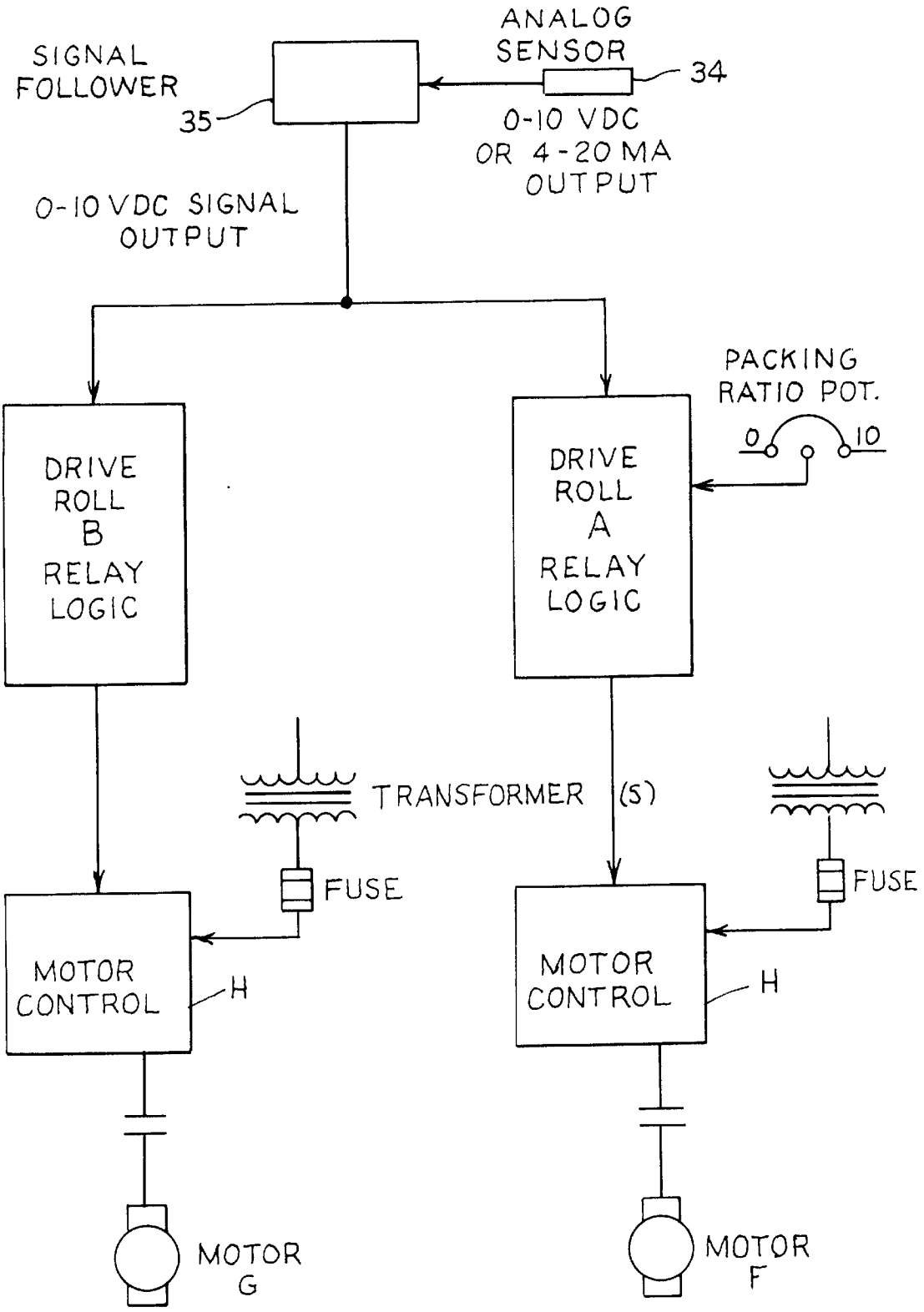
FIG. 2 is a schematic diagram illustrating the electrical components utilized in the preferred embodiment.
Figure 3:
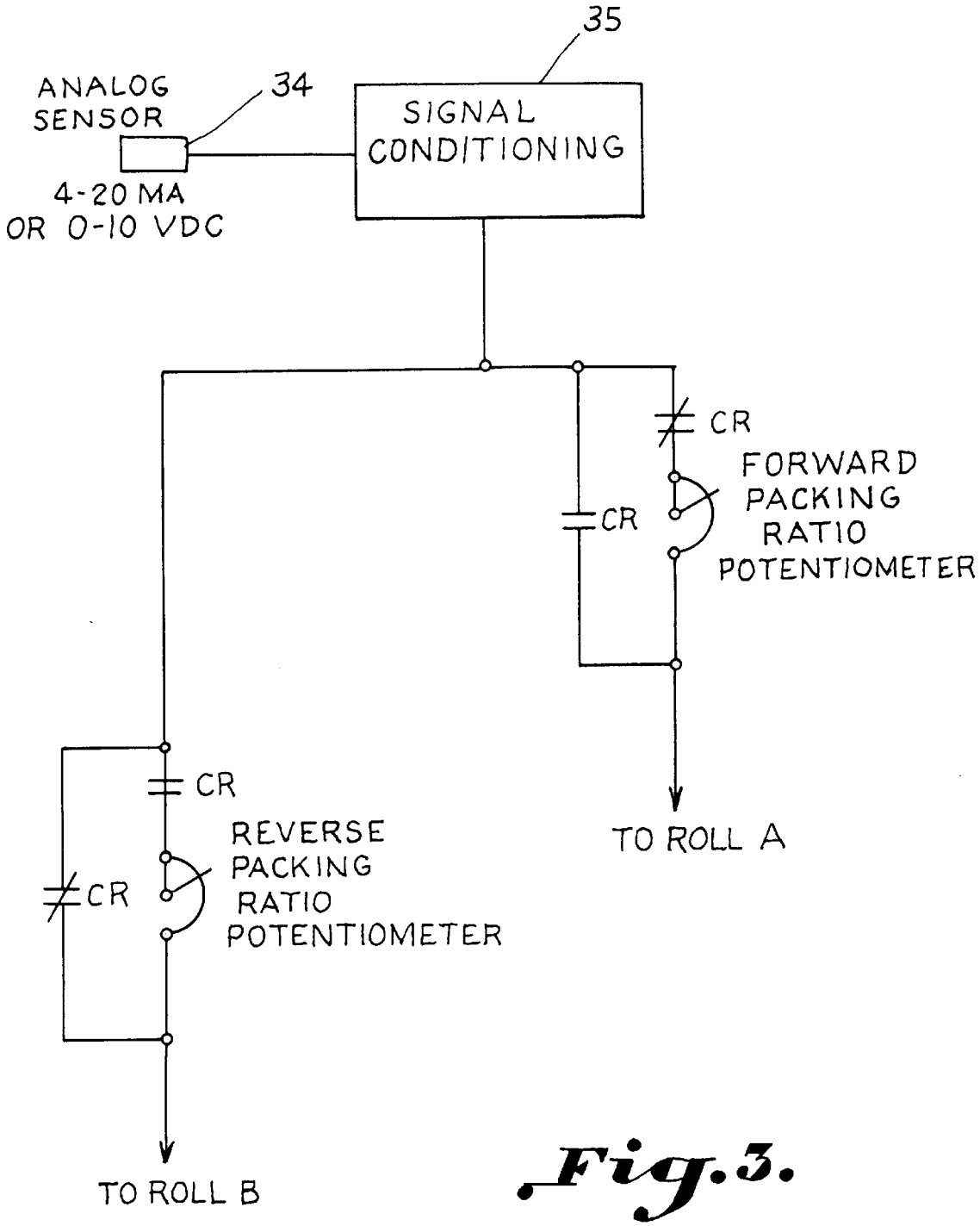
FIG. 3 is a schematic diagram illustrating modified electrical components.

As illustrated in FIGS. 2 and 3, the analog sensor illustrated as proximity switch 34 controls the speed of the take-up. The sensor output of, for example, about 4–20 milliamperes may be converted by a signal follower or conditioning control assembly to about 0–10 volts direct current output for the two drives. The motor controls for the drives can be non-regenerative or regenerative although for this application non-regenerative motor controls are preferred. As stated above, it has been common practice in such take-ups to use fixed packing ratios produced by a differential in sprocket teeth count. On most fabrics this is still the most economical and trouble free method. However, on industrial fabrics such as carbon fibers, fiberglass, and heavy canvas an adjustable packing ratio provides a more desirable flexible means of infinite control providing a desired package density. As illustrated in FIG. 2, a potentiometer is preferably used to vary the speed of roll B between about 0–10%. When driving the take-up in reverse the biggest advantage of the electronic packing ratio is that a reverse packing ratio can be induced to reduce bagging when doffing or just unwinding the fabric roll. FIG. 3 illustrates the use of a separate potentiometer to vary the speed of motors for driving the respective rolls A and B.

While a preferred embodiment of the invention has been described using specific terms, such description is for illustrative purposes only, and it is to be understood that changes and variations may be made without departing from the spirit or scope of the following claims.

What is claimed is:

1. A method of winding cloth as it is manufactured by a loom on a core carried by a surface winder comprising the steps of:

providing a pair of horizontal parallel rolls aligned in side by side relation in a horizontal plane for supporting a core and cloth roll wound thereon;

supporting a compensator roll on the cloth for oscillatory movement by gravity as the cloth travels from the loom toward the parallel rolls responsive to variations in tension in the cloth;

providing a pair of longitudinally spaced shafts each forming a fixed axis for each support roll;

sensing variations in tension upon the cloth responsive to movements of the compensator roll as the cloth is delivered for winding upon the core for forming the cloth roll;

driving each of the parallel rolls independently of any mechanical driving connection therebetween by providing a first drive including a first driven member fixedly carried by a respective one of said support rolls;

utilizing a first motor driving said first drive for rotation by direct connection to said first driven member;

providing a second drive including a second driven member fixedly carried by the other of said support rolls;

utilizing a second motor in general longitudinal alignment with the first motor driving said second drive by direct connection to said second driven member for rotation independently from said first drive and said first motor;

utilizing a motor control circuit supplying power to and controlling the speed of each motor responsive to said variations in tension upon said cloth;

varying the relative speeds of said motors utilizing a variable electrical component to vary the power to at least one of the motors to develop a desired packing ratio independently of variations in tension upon the cloth;

providing a variable potentiometer delivering power to each respective motor;

manually adjusting one of said potentiometers when winding said cloth and manually adjusting the other of said potentiometers when unwinding cloth from said cloth roll; and winding said cloth onto said core;

whereby the tension in the cloth being delivered to the cloth roll is controlled responsive the movement of the compensator roll while controlling the speed of the motors driving respective parallel rolls responsive to tension sensed in the web, and the relative speed of said support rolls may be manually varied to achieve a desired packing ratio.

* * * * *